US007683546B2

(12) United States Patent
Park

(10) Patent No.: US 7,683,546 B2
(45) Date of Patent: Mar. 23, 2010

(54) SULFUR LAMP HAVING ELECTRODES

(75) Inventor: Byeong-Ju Park, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 568 days.

(21) Appl. No.: 11/536,924

(22) Filed: Sep. 29, 2006

(65) Prior Publication Data

US 2007/0075645 A1 Apr. 5, 2007

(30) Foreign Application Priority Data

Sep. 30, 2005 (KR) ..... 10-2005-0092618

(51) Int. Cl.
*H01J 11/00* (2006.01)
*H01J 61/06* (2006.01)
*H01J 65/00* (2006.01)

(52) U.S. Cl. ..... 313/607; 313/621; 313/623; 313/626; 313/634; 313/637; 445/26; 445/27

(58) Field of Classification Search ..... 313/607, 313/623–636, 493, 318.12, 570; 445/26, 445/27

See application file for complete search history.

(56) References Cited

U.S. PATENT DOCUMENTS 6,316,875 B1 * 11/2001 Kirkpatrick et al. ..... 313/633
6,696,788 B2 * 2/2004 Lapatovich et al. ..... 313/634
2002/0180356 A1 * 12/2002 Kirkpatrick et al. ..... 313/607
2004/0080258 A1 * 4/2004 Choi et al. ..... 313/493

OTHER PUBLICATIONS

U.S. Appl. No. 11/536,882 to Park et al., filed Sep. 29, 2006.

* cited by examiner

*Primary Examiner*—Nimeshkumar D. Patel
*Assistant Examiner*—Thomas A Hollweg
(74) *Attorney, Agent, or Firm*—KED & Associates, LLP

(57) ABSTRACT

A sulfur lamp including a power supply that supplies electrical power includes a transparent bulb having a space inside that contains sulfur. Additionally, a plurality of electrodes may be provided on an outside surface of the transparent bulb. Further, one end of each electrode may be connected to the power supply so that the sulfur is excited by an electric discharge to emit light. Therefore, the changing of sulfur contained in the space of the bulb into a plasma phase using the electrodes (not microwaves) avoids a need to use a magnetron, which has a low energy transfer rate, thereby increasing a system efficacy and saving a cost of replacing the magnetron with a new one.

1 Claim, 2 Drawing Sheets

SULFUR LAMP HAVING ELECTRODES

This application claims priority under 35 U.S.C. §119 to Korean Patent Application No. 2005-0092618, filed in Korea on Sep. 30, 2005, the entirety of which is hereby incorporated by reference.

BACKGROUND OF THE INVENTION

1. Field of the Invention

The present invention relates to a sulfur lamp. More particularly, the present invention relates to a sulfur lamp having electrodes, which eliminate the need to use a magnetron.

2. Description of the Background Art

There are various sources of lighting, e.g., an incandescent lamp using heat radiation, a fluorescent lamp including an electric discharge tube that uses a fluorescent material, a high intensity discharge (HID) lamp that uses an electric discharge within a high-pressurized gas or steam, and a plasma lighting system (PLS) lamp that uses an electrodeless discharge.

The various lamps have their respective advantages and disadvantages. For example, the incandescent lamp is excellent in color rendition and has a small size. However, the incandescent lamp is inefficient in emitting light and has a short life. Additionally a switching-on-light circuit of the incandescent lamp is simple and low-priced. The fluorescent lamp is efficient in emitting light and has a relatively long life. However, the fluorescent light has a relatively large size when compared to the incandescent lamp. Additionally, the fluorescent lamp requires a subsidiary switching-on-light circuit. The HID lamp is light-efficient and has a long life, but requires a relatively large amount of time between switching off and on light. In addition, the HID lamp, like the fluorescent lamp, requires a subsidiary light-switching circuit. The PLS lamp has a much longer life, when compared to the above-noted lamps, and is efficient in emitting light. Although low in power consumption, the PLS lamp is high-priced. In addition, the PLS lamp requires a subsidiary switching-on-light circuit.

The PLS lamp is among the latest lamps. An electrodeless sulfur lamp, which belongs to the family of PLS lamps, is a highly-efficient full-spectrum electrodeless lighting system whose light is generated by sulfur plasma that has been excited by microwave radiation. The electrodeless sulfur lamp consists of a golf-ball sized quartz bulb containing several milligrams of sulfur power and argon gas at the end of a thin glass spindle. The bulb is enclosed in a microwave-resonant wire-mesh cage. A magnetron bombards the bulb with 2.45 GHz microwaves. The microwave energy excites the gas to five times atmospheric pressure, which in turn heats the sulfur to an extreme degree forming a brightly glowing plasma capable of illuminating a large area. At an initial stage of switching on light, the discharge occurs in argon which is a buffer gas. As temperature increases, the discharge occurs in sulfurous steam, thereby emitting white light which is excellent in color rendition.

The first prototype of the electrodeless sulfur lamps were 5.9 kW units, having a system efficacy of 80 lumens per watt. The first production models were 1.4 kW with an output of 135,000 lumens. Later models were able to eliminate the need for a cooling fan and improve efficiency to more than 100 lumens/watt.

A problem with the conventional electrodeless sulfur lamp is that the life of magnetron is short-lived when compared to the quartz bulb. The design life of the quartz bulb is currently approximately 60,000 hours. However, the design life of the magnetrons are currently only about 15,000 to 20,000 hours. This requires frequent replacement of the life-expired magnetrons with new ones before the life of the quartz bulb expires. The development in the magnetron generating the micro-wave is relatively slow, which contributes to lowering an energy transfer rate.

BRIEF DESCRIPTION OF THE INVENTION

Therefore, an objective of the present invention is to provide a electrode sulfur lamp having a high efficiency of emitting light and eliminate the need to use a short-lived magnetron (which has a low energy transfer rate).

According to an aspect of the present invention, there is provided a sulfur lamp, including a power supply that supplies electrical power, a transparent bulb having a space provided inside, with sulfur being contained in the space, and a plurality of electrodes, which is provided to an outside surface of the bulb, and of which one end of each electrode is connected to the power supply so that the sulfur is excited by an electric discharge to emit light.

According to another aspect of the present invention, there is provided a sulfur lamp, including a power supply that supplies electrical power, a transparent bulb, made of quartz and having a space inside, with sulfur being contained in the space, a plurality of electrode tubes provided within the transparent bulb, and a plurality of metal electrodes which are encapsulated (or buried in) by the plurality of electrode tubes and of which one end of each electrode is connected to the power supply in such a way that the sulfur is excited by an electric discharge to emit light.

The foregoing and other objects, features, aspects and advantages of the present invention will become more apparent from the following detailed description of the present invention when taken in conjunction with the accompanying drawings.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Reference will now be made in detail to the preferred embodiments of the present invention, examples of which are illustrated in the accompanying drawings.

Figure 1:
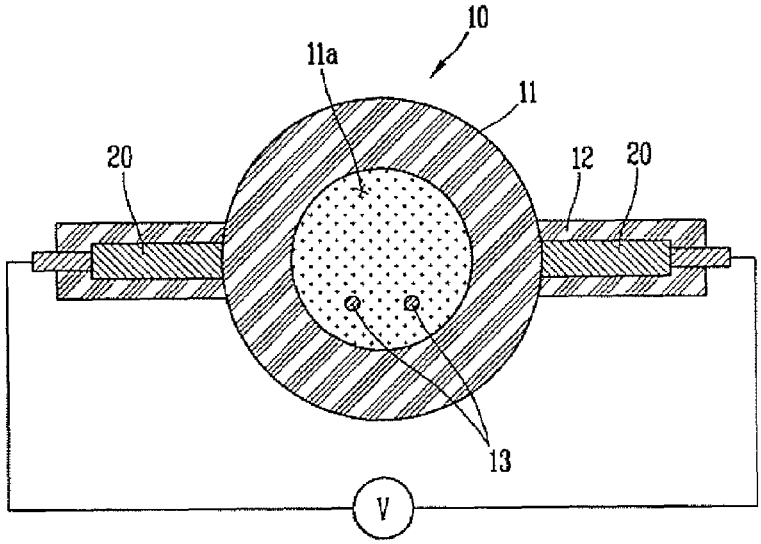
FIG. 1 is a cross-sectional view illustrating a sulfur lamp having metal electrodes according to a first embodiment of the present invention.
Figure 2:
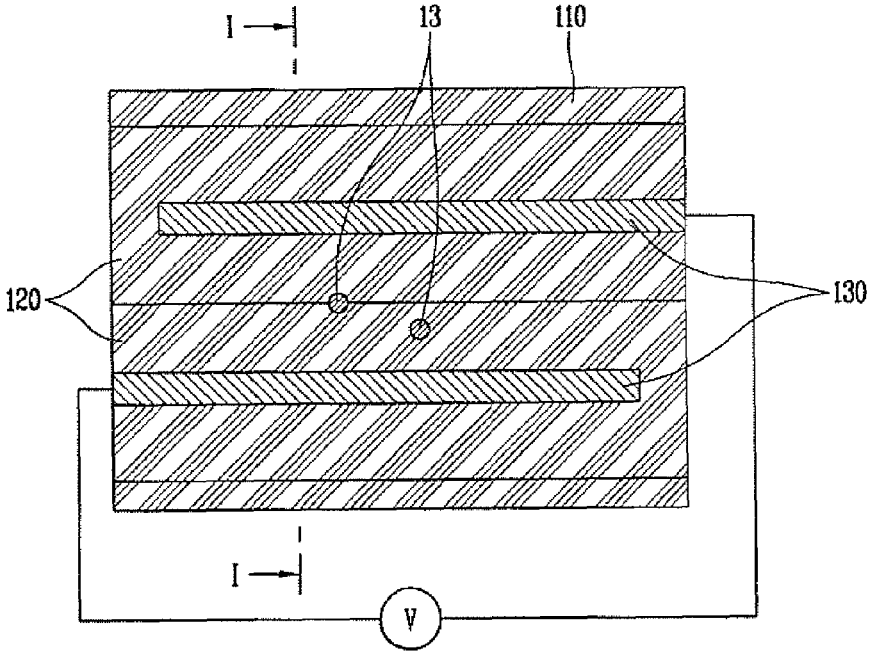
FIG. 2 is a cross-sectional view illustrating a sulfur lamp having metal electrodes according to a second embodiment of the present invention.
Figure 3:
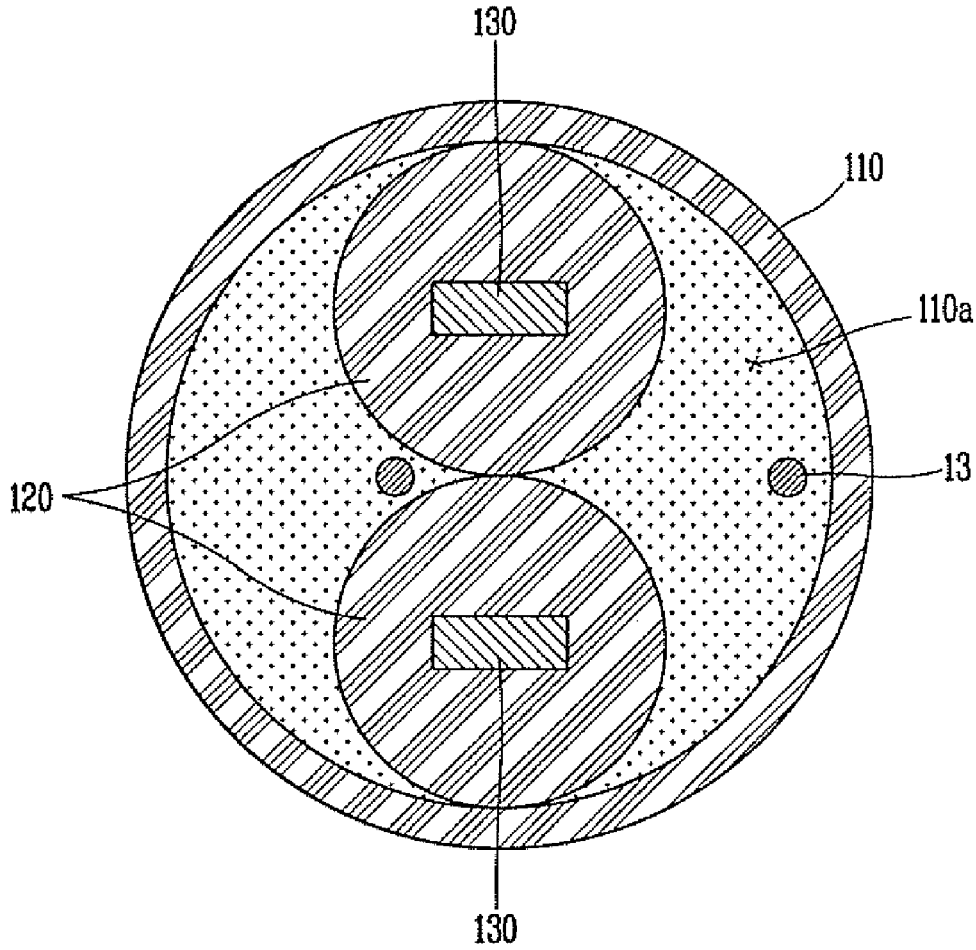
FIG. 3 is a cross-sectional view taken along "I-I" line of FIG. 2.

FIG. 1 is a cross-sectional view illustrating a sulfur lamp having metal electrodes according to a first non-limiting embodiment of the present invention. FIG. 2 is a cross-sectional view illustrating metal electrodes according to a second non-limiting embodiment of the present invention. FIG. 3 is a cross-sectional view taken along "I-I" line of FIG. 2.

As shown in FIG. 1, a sulfur lamp according to a first non-limiting embodiment of the present invention includes a transparent bulb 11 having a space 11*a* inside, a plurality of rods 12 symmetrically protruding from an outside surface of the transparent bulb and a plurality of metal electrodes 20, of which each is buried into (or encapsulated by) each of the rods with one end of each electrode being connected to a power supply and the other end of each electrode being provided so as not to contact the space 11*a*.

The lamp 10 includes the transparent bulb 11 which may be made of quartz, and is thick enough to resist heat occurring within the space 11*a*. Additionally, the plurality of rods 12, into which the plurality of metal electrodes 20 are respectively buried (or encapsulated), and symmetrically protrude from the outside surface of the transparent bulb 11.

Further, in regard to the transparent bulb 11 having the space 11*a* inside, the space 11*a* may contain a main light emitting material such as, but not limited to, sulfur, and a subsidiary electric discharge material such as, but not limited to, argon, neon, zenon or krypton which is in use for initially switching on light.

The metal electrodes 20 may be respectively buried into (or encapsulated) and fixedly supported by the rods 12. The rods 12 and the transparent bulb 11 may be formed as a single body. However, the rods 12 and the transparent bulb 11 may be separately formed. It should also be appreciated, that the rods 12 may be later attached to the transparent bulb 11.

The metal electrodes 20 may be made of conductive material, e.g., the metal electrodes 20 may include conductive materials, such as molybdenum, of which the thermal expansion coefficient is almost equal to or similar to that of quartz. Therefore, preventing differences in expansion and contraction between the metal electrodes and the quartz.

Operation of the sulfur lamp according to the first non-limiting embodiment of the present invention is now described.

The electric discharge, when electrical power is applied to the electrodes, occurs between the electrodes 20 with the transparent bulb 11 positioned in between. Thus, the subsidiary electric discharge material contained in the space changes to a plasma phase thereby generating energy. This energy is transferred to sulfur contained in the space. As a result, the phase of sulfur 13 is changed from a solid phase to a liquid phase, and then to a gas phase, and finally to a plasma phase, thereby emitting visible light.

At this point, contact of one end of each of electrodes with the space 11*a* may cause a violent chemical reaction of the electrodes with sulfur, thus changing the electrodes into a sulfide. This causes the life of the electrode to be shortened. However, according to the embodiment of the present invention, one end of each of the electrodes 20, which are buried in (or encapsulated by) the rods, is not in contact with the space 11*a*. Thus, gas resulting from the chemical reaction may be prevented from screening light, and the life of the electrodes may be prevented from being shortened.

Heat, due to the applying of electrical power to the electrodes, may cause expansion of the electrodes and the rods 12. In this regard, the difference in expansion between the metal electrodes 20 and the quartz rods 12 does not bring about breakage of the rods 12, because the metal electrodes 20 are made of a material (e.g., molybdenum) having a thermal expansion coefficient almost equal to or similar to that of quartz.

A second embodiment of the present invention is now described.

As illustrated in FIG. 2, metal electrodes may be buried into (or encapsulated by) a plurality of electrode tubes, which may be rod-shaped, or elongated (e.g., long-sized), which is formed inside a long-sized, cylindrical bulb.

A lamp, as shown in FIGS. 2 and 3, includes a cylindrical bulb 110, which may be made of quartz, and has a space 110*a* inside containing a plurality of electrode tubes 120, which may be provided in parallel with each other in the space 110*a*, and a plurality of metal electrodes 130 which may be buried into (or encapsulated by) the plurality of electrode tubes 120, with one end of each of the metal electrodes being connected to a power supply. The space 110*a* contains sulfur "S" which may change to plasma phase to emit light.

The bulb 110 may be formed as a single body having a space 110*a* inside. Additionally, the bulb 110 may be made of a quartz material, and have a generally cylindrical or bar shape.

Outside surfaces of the electrode tubes 120 may be fixedly in contact with and in parallel with each other, and at the same time with an inside surface of the bulb 110. Each of the electrode tubes may be formed as a single (or one) body having the metal electrodes 130 buried therein, using quartz material. Additionally, the electrodes may have a generally cylindrical or bar shape.

The metal electrodes 130 may be made of conductive material, such as molybdenum, of which thermal expansion coefficient is almost equal to that of a material of the electrode tube.

Operation of the sulfur lamp according to the second non-limiting embodiment of the present invention is the same as, or similar to, that of the first non-limiting embodiment. Therefore, a description of the operation is omitted. The sulfur lamp according to the second non-limiting embodiment may be long-shaped (or elongated) for a long range of illumination.

The changing of sulfur contained in the space of the bulb into a plasma phase using the electrodes (and not the microwaves) eliminates a need for using the magnetron (which is low in energy transfer rate) thereby increasing a system efficacy and saving a cost for replacing the magnetron.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A sulfur lamp, comprising:

a power supply that supplies electrical power;

a transparent bulb having a space provided therein, wherein sulfur is contained in the space and the transparent bulb is made of quartz;

a plurality of electrode tubes provided within the transparent bulb; and a plurality of electrodes encapsulated by the plurality of electrode tubes, wherein one end of each electrode is connected to the power supply such that the sulfur is excited by an electric discharge thereby emitting light, wherein the transparent bulb is formed as a single body having the space therein, and each of the electrode tubes is formed as a single body having respective electrodes buried therein, wherein the plurality of electrode tubes are disposed to be overlapped with each other in a lengthwise direction, and are provided in parallel with each other inside of the transparent bulb, and wherein outside surfaces of the electrode tubes are fixedly in contact with and parallel to each other, and wherein the outside surfaces of the electrode tubes are fixedly in contact with and parallel to an inside surface of the bulb.

* * * * *